United States Patent [19]

MacDonald et al.

[11] 4,425,999

[45] Jan. 17, 1984

[54] SECURITY SEAL APPARATUS

[76] Inventors: Christopher N. MacDonald, 2300 Fairview Ave., #D-203, Costa Mesa, Calif. 92626; Vesta J. Crow, 2138 Adriatic Ave., Long Beach, Calif. 90810

[21] Appl. No.: 422,709

[22] Filed: Sep. 24, 1982

[51] Int. Cl.[3] ..... B65D 85/57; B65D 55/00; B65D 27/20

[52] U.S. Cl. ..... 206/444; 206/1.5; 206/312; 206/459; 206/493; 292/307 R; 292/314; 292/320; 229/77; 229/75

[58] Field of Search ..... 206/1.5, 312, 444, 459, 206/493; 229/77, 75; 292/310, 314, 307 R

[56] References Cited

U.S. PATENT DOCUMENTS

| | | | |
|---|---|---|---|
| 407,057 | 7/1889 | Brooks | 292/314 |
| 526,112 | 9/1894 | Molly | 229/75 |
| 1,557,183 | 10/1925 | Moats | 292/320 |
| 2,028,423 | 1/1936 | Upham | 292/307 R |
| 2,119,994 | 6/1938 | Love | 292/307 R |
| 2,202,925 | 6/1940 | Schoch | 292/307 R |
| 2,548,104 | 4/1951 | Frison | 292/307 R |
| 2,610,879 | 9/1952 | Pope | 292/320 |
| 3,128,114 | 4/1964 | Nierhaus | 292/320 |

*Primary Examiner*—William T. Dixson, Jr.

*Attorney, Agent, or Firm*—Fulwider, Patton, Rieber, Lee & Utecht

[57] ABSTRACT

There is disclosed a security seal apparatus for securing information recorded on a recording medium such as a floppy disc or recording tape which incorporates an aperture therein. The security seal apparatus includes a circular rigid pad projecting beyond the edges of such aperture and formed centrally with a post for projecting through such aperture. The post is formed on its free extremity with an enlarged-in-diameter conical lock head having its base of a cross-section less than the cross-section of the aperture. A fastener plate is provided with a central opening having a diameter slightly less than the base of such conical lock head so that such fastener plate may be pressed onto such lock head causing the base of the conical lock to be compressed radially inwardly whereby the lock will pass through such opening and expand radially outwardly to overlie the peripheral edges of such opening and lock the fastener in position. In certain embodiments, the bottom of the fastener is dished out slightly to form a somewhat annular conically shaped cavity opening downwardly toward the pad. Also, in one embodiment the fastener plate is dished outwardly away from the pad to engage under the base of the conical fastener.

10 Claims, 12 Drawing Figures

FIG. 1
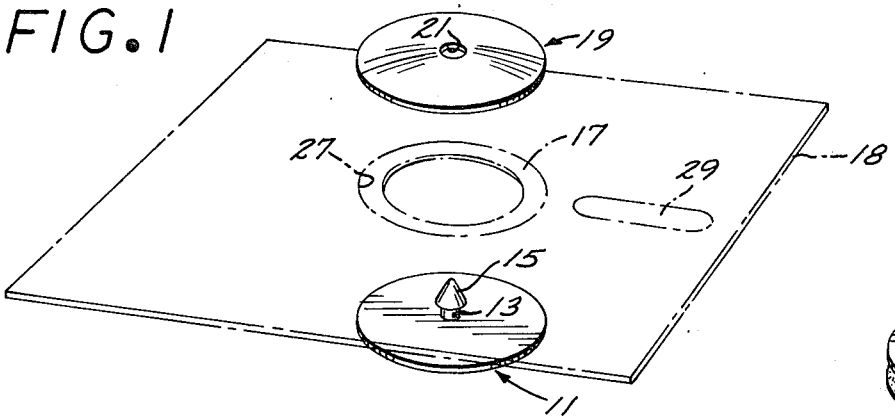
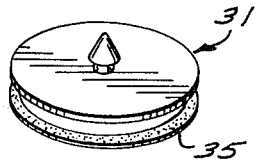
FIG. 5
FIG. 2
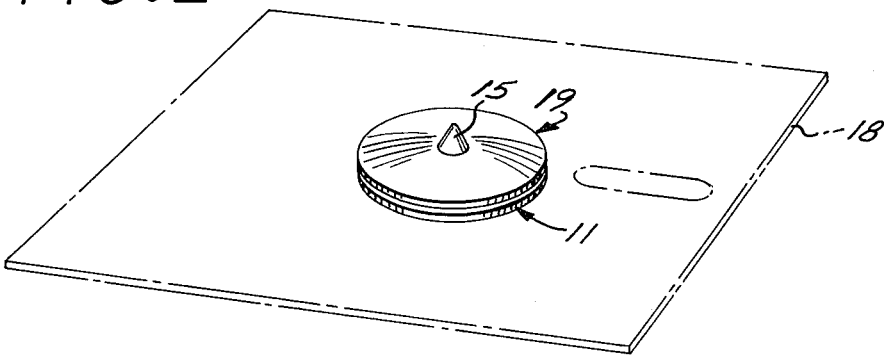
FIG. 6
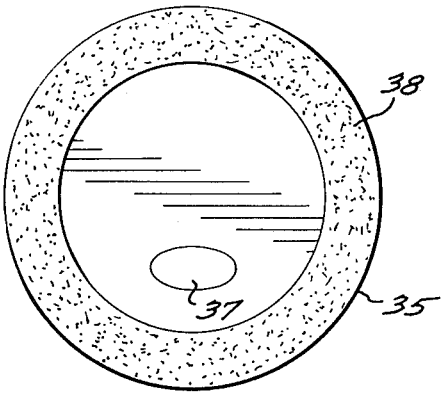
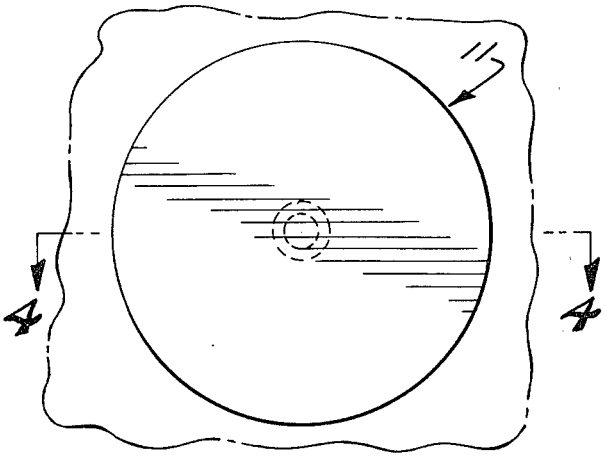
FIG. 3
FIG. 4
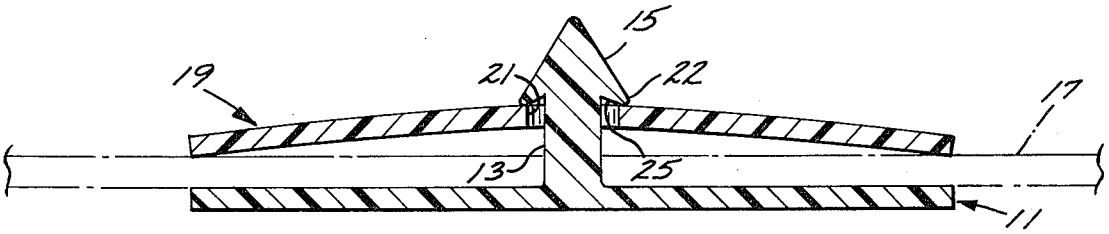

FIG. 7
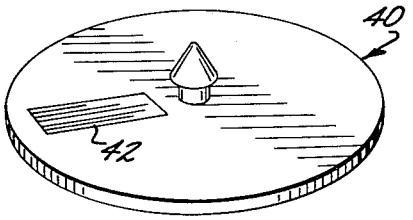
FIG. 8
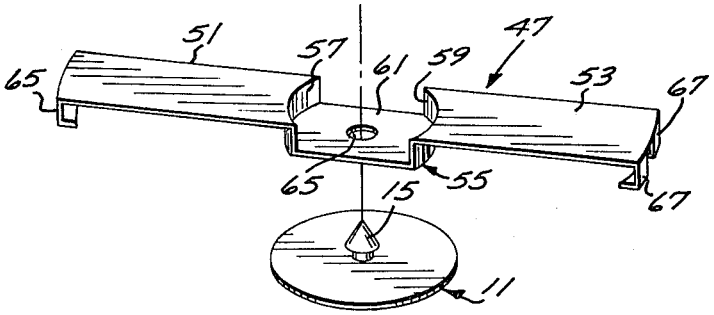
FIG. 9
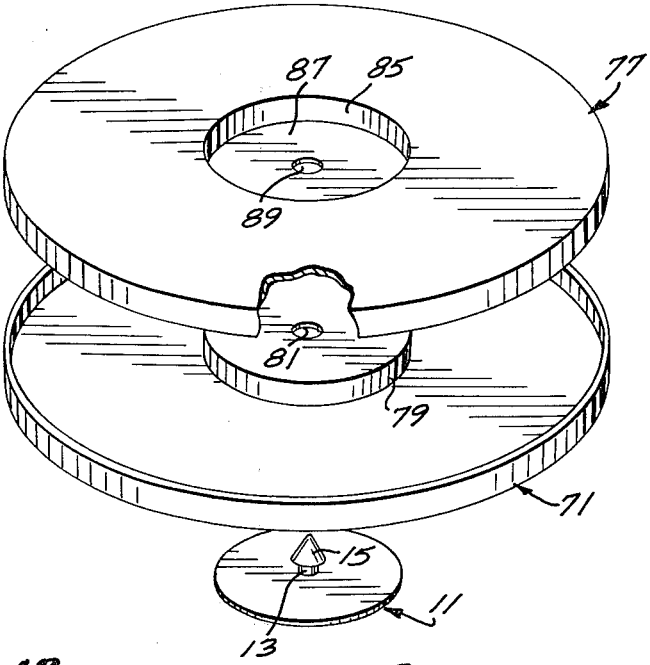
FIG. 10
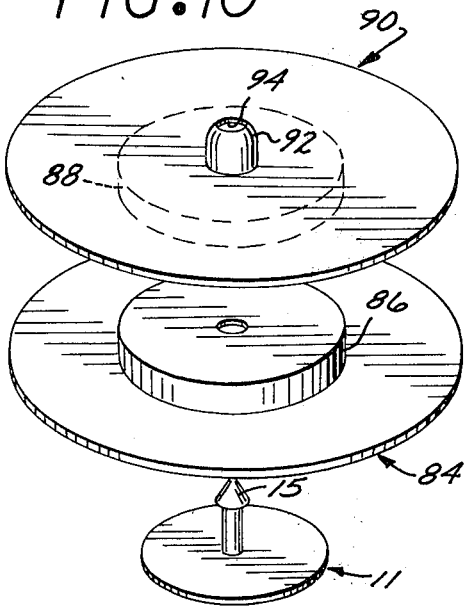
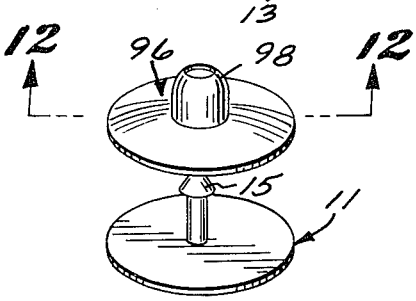
FIG. 11
FIG. 12
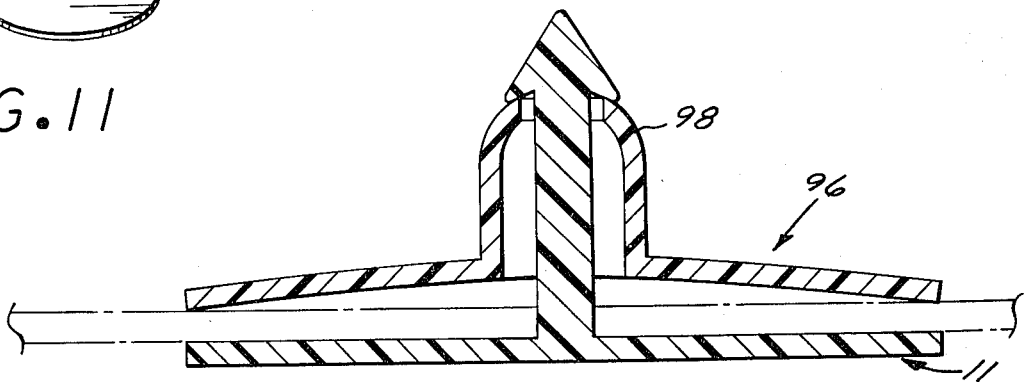

SECURITY SEAL APPARATUS

BACKGROUND OF THE INVENTION

1. Field of the Invention

The present invention relates to portable security devices which may be fastened directly and securely to a holder for a recording medium such that it is transportable with such recording medium while restricting access to the information recorded on such medium.

2. Brief Description of the Prior Art

Prior art security housings for restricting accessibility to information recorded on a tape or disc are generally cumbersome and do not provide for convenient, individual transportation of the disc or tape while restricting access to the information recorded thereon.

With the advent of modern day computers and word processors which rapidly and conveniently store great volumes of information on readily transportable mediums such as discs or tapes, there is great danger of unauthorized persons gaining access to the information recorded on such tapes or discs to extract such information without the knowledge of the owner of such information. For instance, access could be had to such tapes during transporting thereof by a dishonorable courier who may, for instance, sell such information to a competitor. Thus, the disc or tape being transported will arrive at the destination without any indication that access had been had to the information stored thereon and the owner of such information will be put at a tremendous disadvantage due to the fact that such information can be used by another not having the best welfare of such owner in mind.

Consequently, there exists a great need for a security device which is inexpensive to manufacture, readily useable and which provides a safety seal which, when broken, will leave positive evidence of the fact that such seal has been broken and that an unauthorized person has had access thereto.

SUMMARY OF THE INVENTION

The security seal apparatus of the present invention is characterized by a rigid pad for fitting over one side of a holder of a medium on which information is recorded and which includes a central post projecting through an aperture in such holder. A lock is formed on the free extremity of the post and is insertable through an opening in a fastener plate to non-releasably lock such fastener plate in position with such holder securely sandwiched between the plate and pad.

These and other features of the invention will become apparent from a consideration of the following detailed description of the drawings.

DESCRIPTION OF THE DRAWINGS

FIG. 1 is a perspective view of a first embodiment of the security seal apparatus of the present invention as applied to an envelope holding a floppy disc;

FIG. 2 is a perspective view similar to FIG. 1, but showing the security seal apparatus locked together;

FIG. 3 is a bottom view, in enlarged scale, of the security seal apparatus shown in FIG. 2;

FIG. 4 is a sectional view, in enlarged scale, taken along the lines 4—4 of FIG. 3;

FIG. 5 is a perspective view of a second embodiment of the security seal apparatus of the present invention;

FIG. 6 is a top plan view, in enlarged scale, of a coded cover incorporated in the security seal apparatus shown in FIG. 5;

FIG. 7 is a perspective view of a sealing pad incorporated in a third embodiment of the security seal apparatus of the present invention;

FIG. 8 is a perspective view of a fourth embodiment of the security seal apparatus of the present invention;

FIG. 9 is a perspective view of a fifth embodiment of the security seal apparatus of the present invention;

FIG. 10 is a perspective view of a sixth embodiment of the security seal apparatus of the present invention;

FIG. 11 is perspective view of a seventh embodiment of the security seal apparatus of the present invention; and, FIG. 12 is a transverse sectional view, in enlarged scale, taken along the lines 12—12 of FIG. 11 and showing the security seal apparatus locked together.

DESCRIPTION OF THE PREFERRED EMBODIMENTS

Referring to FIGS. 1 and 4, the security seal apparatus of the present invention includes, generally, a disc shaped rigid or semi-rigid pad 11 formed centrally with an upstanding post 13 for projection through the central aperture in a floppy disc 17 or the like carried in a holder envelope 18. Formed integrally with and at the top end of the post 13 is a resilient, compressible conical lock head 15 for projection through the central aperture in the disc 17 to be compressibly pressed through the central opening 21 of a rigid or semi-rigid fastener plate 19. With the floppy disc 17 so sandwiched in locked condition between the pad 11 and fastener plate 19, access to such floppy disc for taking the information therefrom without severance of the post 13 or mutilation of the fastener plate 19, either of which would leave visible evidence of tampering.

As set forth hereinabove, it is recognized that, will modern day technology and the ingenuity of unscrupulous persons, absolute security of information recorded on readily readable discs and tapes in such a manner as to render such securement convenient and practical in the business world borders on the impossible. Additionally, it is recognized that the greatest injury results when unauthorized access to sensitive information is obtained without the knowledge of the owner of such information. This injury stems from the fact that the information can be employed by, for instance, a competitor in discovering one's secret plans and methods and possible plans for the future. Additionally, it is recognized, that while absolute security may be impractical, the deterrent resulting from notice to the unscrupulous that the owner of the sensitive information will be alerted as to the fact that unauthorized access has been had to such information, is often sufficient to discourge theft of the information since such access. Typically discs and tape reels are formed with central apertures to which access must be had to retrieve information stored thereon by conventional means. It is the object of the present invention to apply a seal to such central aperture so such information cannot be retrieved by unauthorized individuals having access to present day retrieval systems.

With these objectives in mind, it will be recognized that the security pad 11 may be constructed of any desirable material which exhibits a rigid or semi-rigid characteristic with the diameter of the central aperture in the floppy disc such that the pad cannot be drawn through such aperture without physically damaging the disc itself. The post 13 preferrably is formed integral with the pad 11 or is joined therewith in such a manner that separation from the pad 11 will leave evidence that there has been a separation, thus alerting a recipient of a disc secured by such security seal apparatus that there has been tampering.

Likewise, the conical lock 15 may be formed integral with the post 13, it being recognized that some compressibility or flexibility is required in such lock. The lock itself is formed at its base with a peripheral flange 22 having a diameter smaller than the diameter of the aperture in the floppy disc 17 but greater than the diameter of the fastener opening 21 in the fastening plate 19. Also, the underside of the conical lock 15 is preferrably formed with an annular conical cavity 25 to form a skirt, thus affording greater flexibility in the flange 22 so that such flange may be easily pressed downwardly and inwardly to permit convenient passage through the undersized fastener opening 21. It will be appreciated that the general conical shape of the flange 22, in essence, provides for one-way passage of such conical lock 15 such that attempts to withdraw the fastener plate 19 from such lock will result in the plate forming the edges of the fastener opening 21 tending to raise such flange 22 and unfold it back over the exterior body of the cone 15, which folding will be restricted by the conical shape of the flange itself. Soft plastic has been found particularly useful for construction of the conical lock 15 to thus afford the desired degree of flexibility for convenient passage of the flange 22 through the fastener opening 21 while exhibiting sufficient resistance to upwards folding of such flange to substantially prevent removal of the fastener plate 19 without visible damage to the conical lock 15 or such fastener plate 19.

The fastener plate 19 may also be constructed of rigid or semi-rigid plastic and is of a diameter greater than the central aperture in the floppy disc 17 to prevent passage through such aperture without evident damage to the floppy disc 17 or plate 19. In referring to FIG. 4, in the preferred embodiment, the plate 19 has some resiliency and is dish shaped to exhibit somewhat of a conical configuration such that the central portion thereof defining the opening 21, under the inherent bias of such plate, is raised relative to the outer periphery thereof to thus maintain a slight bias of the outer periphery of such plate against the disc 17 to mainatin it sandwiched snugly against the facing surface of the pad 11.

In practice, it will be appreciated that floppy discs and other recording medium are frequently stored in folders, such as the envelope 18 which is formed with an oversized central aperture 27, slightly larger than the central aperture of the disc 17, and is then formed with a somewhat rectangularly shaped window 29 for access to the disc of a reading head (not shown). In other configurations, the recording medium may be in the form of a rigid or floppy disc without an envelope and, in still further configurations, the sensitive information may be recorded on linear tape wound on a reel as discussed hereinafter.

In operation, when the floppy disc 17 is to be stored with sensitive information thereon or is to be handed over to a courier or the like for transporting to a distant terminal or other destination, the security seal apparatus of the present invention may be utilized to deter unauthorized access to such information and to afford perceivable evidence of any such unauthorized access should it take place. The dispatcher preparing the floppy disc 17 to hand over to such courier, may conveniently withdraw a security pad 11 and mating fastener plate 19 from stock and quickly assemble such pad and plate together sandwiching such floppy disc therebetween. Such assembly will be accomplished by merely inserting the conical lock 15 and post 13 through the central aperture of such floppy disc and bringing the fastener plate 19 into position over the lock 15. Downward pressing of the central portion of such fastener plate will tend to press the base flange 25 of the conical lock head 22 downwardly and inwardly until the edges of such opening 21 clear such base flange 22. It will be appreciated that such onwardly and inwardly compression of the base flange 22 is facilitated by the fact that the conical cavity 25 provides a skirt shape for such flange 22 which presses radially inwardly in a relatively easy fashion. After such flange 22 has cleared the edge of the opening 21, such flange 22 will snap radially outwardly to overlie the edges of such opening 21 and prevent unauthorized removal of the fastener plate. It will be appreciated that in the case of a dish shaped plate 19, some inherent bias in the fastener plate 19 will tend to maintain the floppy disc envelope 27 pressed firmly against the pad 11.

Should the courier be tempted to, either himself or through others, obtain access to the information recorded on the floppy disc 17, it will be necessary for him to remove the fastener plate 19 by severing the lock head 15 from the post 13 or enlarging the fastener plate opening 21. In either instance, the physical damage to the post 13 or fastener plate 21 will be evident thus alerting the recipient of the floppy disc 17 that the security seal apparatus has been tampered with, thus touching off an investigation as to the tampering and initiating precautionary steps to diffuse any advantage obtained from such unauthorized access to the sensitive information.

It will be appreciated that unscrupulous individuals frequently possess high degrees of sophistication and that, eventually, such unscrupulous persons may have access to security pads 11 such that any such pad damaged while seeking unauthorized access to the information on the disc 17 may be replaced by a similar appearing disc, thus tending to defeat the aforementioned evidentiary value of the subject security seal. It is for this purpose that the security pad, generally designated 31 in FIGS. 5 and 6, is provided. This security pad is of the same general configuration as the security pad 11 and is covered on its exterior side by a disc shaped cover 35. The disc shaped cover 35 is provided on its interior surface facing the pad 31 with a code area 37 which may bear any desired code such as a known fingerprint. Such code area 37 may be undetectable under ordinary circumstances such that an unscrupulous person desiring to obtain access to the information on the floppy disc 17 may not be alerted to the fact that the cover 35 is coded. It will be noted that the cover 35 is attached around its peripheral edge to the peripheral edge of the pad 31 by means of a self-adhesive 38.

In operation, the code, such as a fingerprint, is coded in the code area 37 prior to release of the secured floppy disc 17 to a courier or the like and the intended recipient is notified, as by advance notification, of the code which should be expected to be found in the print area 37. Thus, the recipient of the floppy disc may easily and conveniently remove the cover 35 and examine the code area 37, as under a blue light, for the expected code. If the courier, or those acting in concert with him, have damaged the original pad 31, or post 13, and replaced such pad with a substitute pad, the expected code on the code area 37 will not be found, thus alerting the recipient to the fact that access has been had to the information on the floppy disc 17.

The third embodiment of the security seal apparatus of the present invention shown in FIG. 7 includes a base pad 40 having a known code 42 on the interior surface thereof to discourage the unscrupulous from reproducing an identical pad and code.

Referring to the fourth embodiment of the security seal apparatus of the present invention as shown in FIG. 8, it is common practice to record information on a magnetic tape or film tape which is then stored on a holder in the form of a reel (not shown). To accommodate holders of this type, I have constructed my invention in the form of the security pad 11 to be coupled to a bracket, generally designated 47. The bracket 47 is constructed to span the diameter of the reel and is formed with oppositely disposed arms 51 and 53 joined together on their medial ends by means of a boss, generally designated 55. The boss 55 is formed by a depression which defines oppositely disposed segmental cylindrical walls 57 and 59 connected on their respective one ends to the medial ends of the arms 51 and 53 and are joined on their opposite ends by means of a flat fastener plate 61 configured to overlie the facing surface of the security pad 11. The fastener plate 61 is formed centrally with a fastener opening 65 which is sized for compressive receipt of the lock head 15 as the bracket 47 and pad 11 are joined and to then expand and lock such pad and bracket into locking engagement. The distal end of the bracket arm 51 is formed with a downturned hook 65 and the distal end of the arm 67 is formed with a pair of downturned hooks 67 for fitting over the opposite edges of the reel. The circumferentially spaced apart hooks 67 accommodate therebetween the reel tape lock (not shown).

In operation, it will be appreciated that the tape bearing the sensitive information is wound on the reel and that the security seal apparatus will be applied to such reel prior to dispatch thereof from the secured area. In this regard, the bracket 47 is applied to one side of the reel by inserting the boss 55 in the central aperture while flexing the arms 51 and 53 to hook the hooks 65 and 67 over the opposite edges of such reel. It will be appreciated that the bracket 47 fits the reel sufficiently loosely so that the boss 55 may be inserted in the central aperture while the arms 51 and 53 are flexed to hook the hooks 65 and 67 over the opposite edges of the reel. The pad 11 is then brought into position in the opposite side of the reel and the conical lock 15 inserted in the opening 65 to non-releasably lock such pad 11 in position to block removal of the bracket 47.

The fifth embodiment of the security seal apparatus of the present invention is shown in FIG. 9 and incorporates a security pad 11 for use with a cylindrical reel can, generally designated 71 and covered by a cylindrical wheel cover generally designated 77. The can 71 is formed centrally with a raised cylindrical hub 79 configured to be received in the central aperture of the reel and defining a cylindrical cavity for receipt of the pad 11. The hub 79 is formed centrally with a bore 81 through which the conical lock head 15 freely passes.

The cover 77 is also formed with a depressed hub 85 which is configured to be received in the central aperture of the reel and forms a bottom wall in the form of a fastener plate 87. The fastener plate 87 is formed with a fastener opening 89 which is compressibly received over the conical lock head 15 to form a one-way lock as described herein with respect to the embodiment shown in FIG. 1.

The sixth embodiment of the security seal apparatus of the present invention shown in FIG. 10 incorporates a circular holder 84 including a hub 86 which abuts the facing surface of a hub 88 formed on a fastener plate, generally designated 90. The fastener plate 90 is also formed with a raised dome 92 for sliding receipt of the lock head 15 to project through a fastener opening 94 formed in the top thereof.

The seventh embodiment of the security seal apparatus of the present invention as shown in FIG. 11 is similar to the apparatus shown in FIGS. 1 and 10 and incorporates a fastener plate, generally designated 96, which is dished upwardly centrally away from the security pad 11 and is formed centrally with a lock receiving dome 98.

From the foregoing it will be apparent that the security seal apparatus of the present invention provides a convenient and practical means for securing information bearing media against unauthorized extraction of the information. The apparatus itself is inexpensive to manufacture and does not lend itself to defeat by an expert lock pick.

I claim:

1. A security seal apparatus for restricting access to an aperture formed centrally in a work piece carrying sensitive information thereon, said assembly comprising:

a rigid pad for covering said one side of said work piece and including a stem projecting from one side thereof for projecting through said aperture when said pad is positioned in covering position on said one side;

a fastener plate for overlying said pad, being of sufficient size to project beyond the peripheral edges of said aperture and being formed centrally with and opening; and, a lock formed on the free end of said stem, said lock being characterized in that it passes freely through said opening and is reponsive to projection beyond the periphery of said opening to non-releasably lock said pad and fastener plate together to seal said pad and plate in sealing engagement in said aperture whereby said stem must be severed to remove said pad from said one side thus leaving perceivable evidence that access has been had to said work piece.

2. A security seal apparatus as set forth in claim 1 that includes:

code means on said pad; and, an opaque cover on said pad and covering said code means.

3. A security seal apparatus as set forth in claim 1 wherein:

said fastener lock is constructed of resilient material and is conical in shape to define a flange which may be compressed to fit through said opening and is then expanded to lock against retraction through said opening.

4. A security seal apparatus as set forth in claim 1 wherein:

said fastener plate is formed with tube means projecting therefrom to house said stem and form in the end thereof said opening.

5. A security seal apparatus as set forth in claim 1 that includes:

code means on said pad.

6. A security seal apparatus as set forth in claim 1 for use with a two sided reel of information bearing tape or film and being formed centrally with said aperture and having a predetermined diameter and wherein:

said fastener plate is in the form of a bracket spanning said reel and including hooks on its opposite extremities for hooking over the diametrical opposite sides of said reel.

7. A security seal apparatus as set forth in claim 6 wherein:

said bracket is formed with a boss which closely fits the interior of said opening.

8. A security seal apparatus as set forth in claim 2 wherein:

said code means is in the form of a fingerprint.

9. A security seal apparatus as set forth in claim 1 for use with an information containing reel of a predetermind diameter and wherein:

said plate is incorporated in a cup shaped cover for covering one side and the edges of said reel.

10. A security seal apparatus as set forth in claim 1 wherein:

said fastener plate is dish shaped to space the edges of said opening away from said pad relative to the outer periphery of said plate when said pad and fastener plate are locked together.

* * * * *